US007556340B2

(12) United States Patent
Umeda et al.

(10) Patent No.: US 7,556,340 B2
(45) Date of Patent: Jul. 7, 2009

(54) INK JET RECORDING APPARATUS

(75) Inventors: Takaichiro Umeda, Nagoya (JP); Hiroaki Yazawa, Nagoya (JP); Hikaru Kaga, Nagoya (JP); Hisaki Sakurai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 359 days.

(21) Appl. No.: 11/421,309

(22) Filed: May 31, 2006

(65) Prior Publication Data

US 2006/0268051 A1 Nov. 30, 2006

(30) Foreign Application Priority Data

May 31, 2005 (JP) ..... 2005-159968

(51) Int. Cl.
*B41J 2/165* (2006.01)

(52) U.S. Cl. ..... 347/29; 347/32; 347/33

(58) Field of Classification Search ..... 347/22, 347/23, 24, 29, 30, 32
See application file for complete search history.

(56) References Cited

U.S. PATENT DOCUMENTS

| | | | | |
|---|---|---|---|---|
| 5,801,736 | A | 9/1998 | Ikkatai et al. | |
| 6,283,585 | B1 | 9/2001 | Ikkatai et al. | |
| 6,536,866 | B1 * | 3/2003 | Uchikata | 347/24 |
| 6,742,862 | B2 * | 6/2004 | Yamada et al. | 347/30 |
| 7,354,133 | B2 * | 4/2008 | Ide et al. | 347/23 |
| 2006/0197786 | A1 * | 9/2006 | Yokozawa | |

FOREIGN PATENT DOCUMENTS

| | | | |
|---|---|---|---|
| JP | 4364960 | A | 12/1992 |
| JP | 8132640 | A | 5/1996 |
| JP | 10-193648 | * | 7/1998 |
| JP | 2004090529 | A | 3/2004 |

* cited by examiner

*Primary Examiner*—shih-wen hsieh
(74) *Attorney, Agent, or Firm*—Baker Botts L.L.P.

(57) ABSTRACT

Three nozzle caps for sealing the surface of a recording head are provided in correspondence to an ink tank group of Y, C, and M, an ink tank group of R, G, and B, and an ink tank group of photo-K and K. Then, ink is sucked for each of the three nozzle caps by a suction pump.

15 Claims, 8 Drawing Sheets

INK JET RECORDING APPARATUS

CROSS-REFERENCE TO RELATED APPLICATIONS

This Nonprovisional application claims priority under 35 U.S.C. §119(a) on Patent Application No. 2005-159968 filed in Japan on May 31, 2005, the entire contents of which are hereby incorporated by reference.

BACKGROUND

The present invention relates to an ink jet recording apparatus and, in particular, to a technique for reducing ink discharged at the time of maintenance of nozzles.

In the prior art, ink jet recording apparatuses have been realized that can perform color recording by using ink of a plurality of colors (e.g., yellow ("Y", hereafter), cyan ("C", hereafter), magenta ("M", hereafter), red ("R", hereafter), green ("G", hereafter), blue ("B", hereafter), photo black ("photo-K", hereafter), and black ("K", hereafter)). In such an ink jet recording apparatus, nozzles for discharging each color ink are provided in a recording head. Then, ink is selectively discharged from each nozzle onto a recording medium, so that an image is recorded onto the recording medium.

Meanwhile, it is known that when dust or air enters into the nozzles or alternatively when ink in the nozzles dries up and solidifies, the nozzles are clogged and go into a state that ink cannot be discharged (that is, non-discharge state). In order that this non-discharge state should be recovered into a normal state, various kinds of maintenance operations are performed like a suction purging operation, a positive pressure purging operation, and a flushing operation. At the time of execution of such maintenance operations, new ink is also discharged forcedly in order that the dust, the air, or the solidified ink should forcedly be removed from the inside of the nozzles. The ink discharged at the time is eventually discarded when stored into a waste ink reservoir or alternatively absorbed by a waste ink absorbing material as described in Japanese Patent Application Laid-Open No. H4-364960 (1992) (page 4) and Japanese Patent Application Laid-Open No. H8-132640 (1996) (page 6).

Here, the situation that a large amount of ink not used in recording is discarded at the time of maintenance operations described above indicates that the amount of ink decreases that could be used for recording. This has caused the problem of an increase in the running cost such as the ink cost.

Further, in the case that the above-mentioned recording head that performs color recording is constructed so as to perform the maintenance operations for each of different inks independently, there arises a problem that the size of the apparatus is increased and that the control thereof is complicated.

Thus, in order to simplify the configuration and control of the maintenance mechanism, the maintenance mechanism has been invented in which the maintenance operation is performed simultaneously for a plurality of recording heads by sharing one maintenance mechanism with a plurality of recording heads, and by employing a nozzle cap capable of covering the plurality of recording heads.

SUMMARY

Nevertheless, in the case that the one maintenance mechanism is shared with the plurality of the recording head, the time required for completing recovery operations of all of the recording heads becomes longer. Further, since the various color inks are discharged in the one mechanism, the other color inks are adhered to the nozzles of the recording head by performing the maintenance operation, thereby causing color mixing. Also, in the mechanism in which the maintenance operation is performed for the plurality of the recording heads simultaneously, since a plurality of inks mix in the same nozzle cap, color mixing may occur in the nozzles of the recording head.

Furthermore, a frequency of operations (a frequency of use of an ink) is different according to color of ink to be used in the recording head. In order to maintain the stable printing quality, it is preferable that a frequency which the recovery operation is required is determined according to the frequency of use of an ink. However, in the maintenance in which the maintenance operation is performed for the plurality of recording heads simultaneously, the frequency of use of an ink is not considered with respect to the recording heads which the maintenance operation is performed simultaneously.

Thus, for example, in a case that an ink tank group has a high frequency of recovery operations while another ink tank group has a low frequency of recovery operations, suction purging operations for the ink tank group having a low frequency of recovery operations have been performed at the same time as those for the ink tank group having a high frequency of recovery operations. This has caused uselessly discarded ink in the ink tank group having a low frequency of recovery operations.

Therefore, it is an object to provide an ink jet recording apparatus in which uselessly discarded ink can thereby be reduced that could be caused by an unnecessary maintenance operation, and which can prevent color mixing due to the maintenance operation in the nozzles of the recording head.

An ink jet recording apparatus according to a first aspect for the purpose of resolving the above-mentioned problem comprises: a plurality of ink tanks each for storing ink of each color; a recording head provided with nozzles for discharging onto a recording medium the ink stored in the plurality of ink tanks; a nozzle cap for sealing the surface of the recording head in which the nozzles are formed; and a pressure unit for applying pressure to discharge the ink from the recording head into the nozzle cap. Then, the plurality of ink tanks are classified into at a plurality of groups in the order of frequency of use, while a plurality of the nozzle caps are provided in correspondence to the groups of the classified ink tanks.

According to this configuration, ink can be discharged from the recording head into the nozzle cap by the pressure unit for each of the groups of ink tanks classified in the order of frequency of use. As described later, when the frequency of use of an ink is different, the frequency of recovery operations is also different. Thus, even in the case that an ink tank group has a high frequency of use and another ink tank group has a low frequency of use, suction purging operations for the ink tank group having a low frequency of use are not performed at the same time as those for the ink tank group having a high frequency of use. This reduces uselessly discarded ink in the ink tank group having a low frequency of use.

The above and further objects and features will more fully be apparent from the following detailed description with accompanying drawings.

DETAILED DESCRIPTION OF THE EXEMPLARY EMBODIMENTS

Embodiments are described below with reference to the drawings.

First Embodiment

[Description of General Configuration of Ink Jet Recording Apparatus 1]

Figure 1:
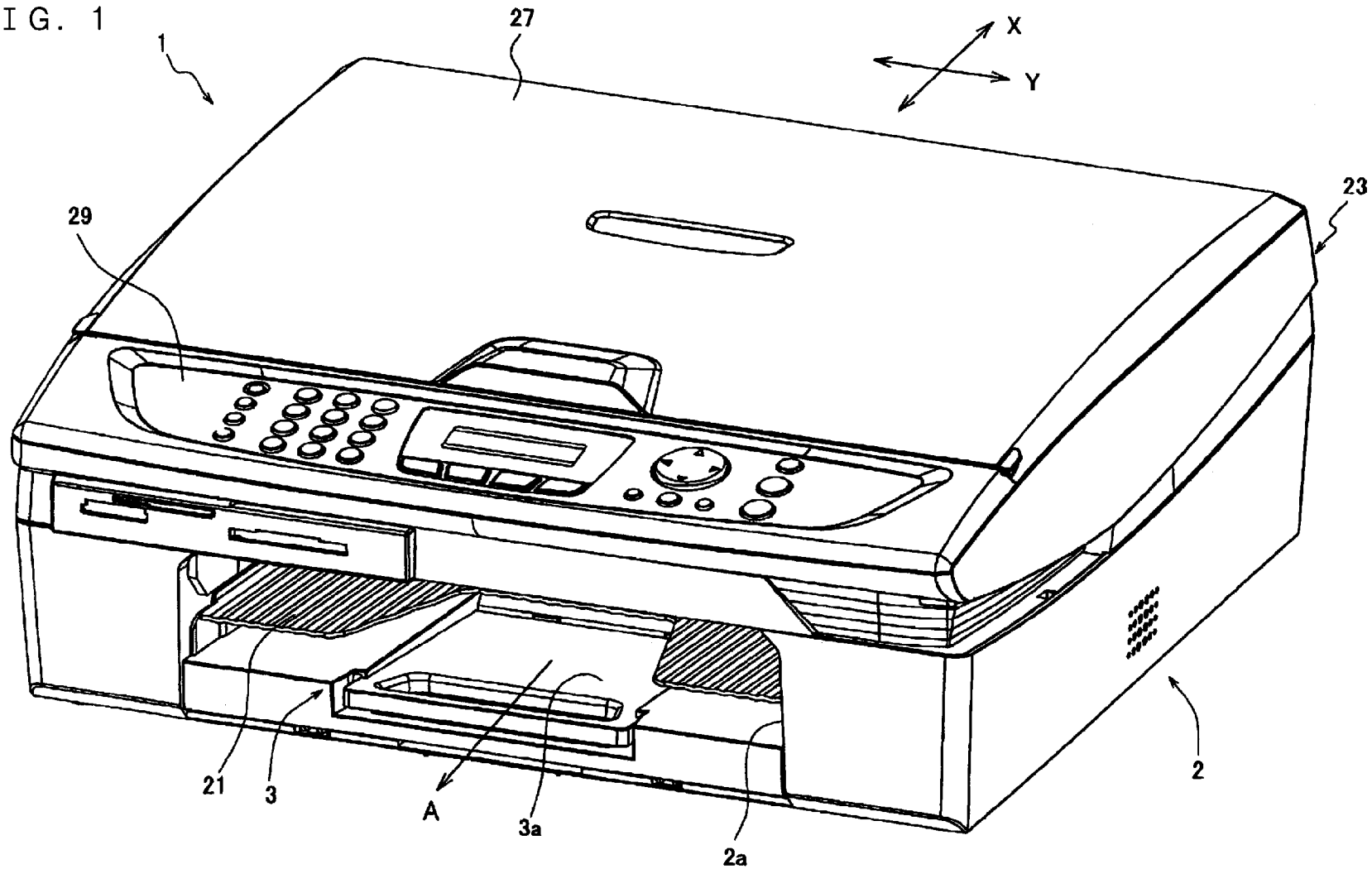
FIG. 1 is an outer shape perspective view of an ink jet recording apparatus 1 according to the present embodiment.

FIG. 1 is an outer shape perspective view of an ink jet recording apparatus 1 according to the present embodiment.

The ink jet recording apparatus 1 is a so-called multi function device (MFD) provided with a printer function, a copy function, a scanner function, a facsimile function, and the like, and a sheet shaped medium composed of paper, plastic film, or the like is used as a recording medium.

The ink jet recording apparatus 1 is provided with a sheet paper cassette 3 which is located in the bottom part of a housing 2 composed of synthetic resin and which can be inserted through an opening 2*a* formed in the front part of the housing 2. Further, a paper discharge section 21 for receiving a recorded paper sheet conveyed in the direction indicated by an arrow A is provided over the sheet paper cassette 3. A sheet discharge opening which communicates with the paper discharge section 21 is provided in common in the upper part of the opening 2*a* in the front face of the housing 2.

The sheet paper cassette 3 can accommodate a plurality of paper sheets having been cut, for example, into the A4 size, the letter size, the legal size, or the postcard size. Each paper sheet is arranged such that its longer sides should be in parallel to the sheet conveyance direction (sub-scanning direction or X-axis direction). Further, at the front end of the sheet paper cassette 3, an auxiliary support member 3*a* for supporting the rear end part of a long paper sheet such as a legal size sheet is attached in a manner extendable in the X-axis direction. When paper sheets such as A4 size sheets that can completely be accommodated inside the sheet paper cassette 3 are used, the auxiliary support member 3*a* can be retracted relative to the front part of the sheet paper cassette 3 such as not to disturb sheet feeding.

On the other hand, in the upper part of the housing 2, an image reading device 23 is arranged that is used in manuscript reading when the copy function or the facsimile function is utilized. This image reading device 23 is constructed in a manner capable of being rotated and thereby opened and closed in the up and down directions about a pivot part (not shown) relative to one side-end part of the housing 2. Further, in the upper part of the image reading device 23, a manuscript cover body 27 for covering the upper surface of the image reading device 23 is attached in a manner capable of being rotated and thereby opened and closed in the up and down directions about a pivot (not shown) provided at the rear edge of the image reading device 23.

In image reading, the manuscript cover body 27 is opened upward. Then, a manuscript is placed on a glass plate for placing (not shown). In this state, a contact image sensor (CIS) for manuscript reading (not shown) provided under the glass plate for placing (not shown) in a manner capable of reciprocating motion in the Y-axis direction (main scanning direction) scans the manuscript paper, and thereby reads the image of the manuscript paper.

An operation panel section 29 provided with various kinds of operation buttons, a liquid crystal display section, and the like is arranged in front of the manuscript cover body 27 located in the upper surface of the image reading device 23.

In the inside of the housing 2, a recording unit (not shown) is provided that comprises: a carriage 40 (see FIGS. 2A to 2C) that carries an ink jet type recording head 30 and eight ink tanks 31-38 for the purpose of implementing the printer function as described later (see FIGS. 2A to 2C) and that can perform reciprocating motion in the Y-axis direction (main scanning direction); and other mechanisms. The recording head 30 discharges ink at the time of the scan, and thereby records an image onto a paper sheet arranged stationary under the recording head 30.

[Description of Configuration of Recovery Operation Unit 50]

Figure 2A:
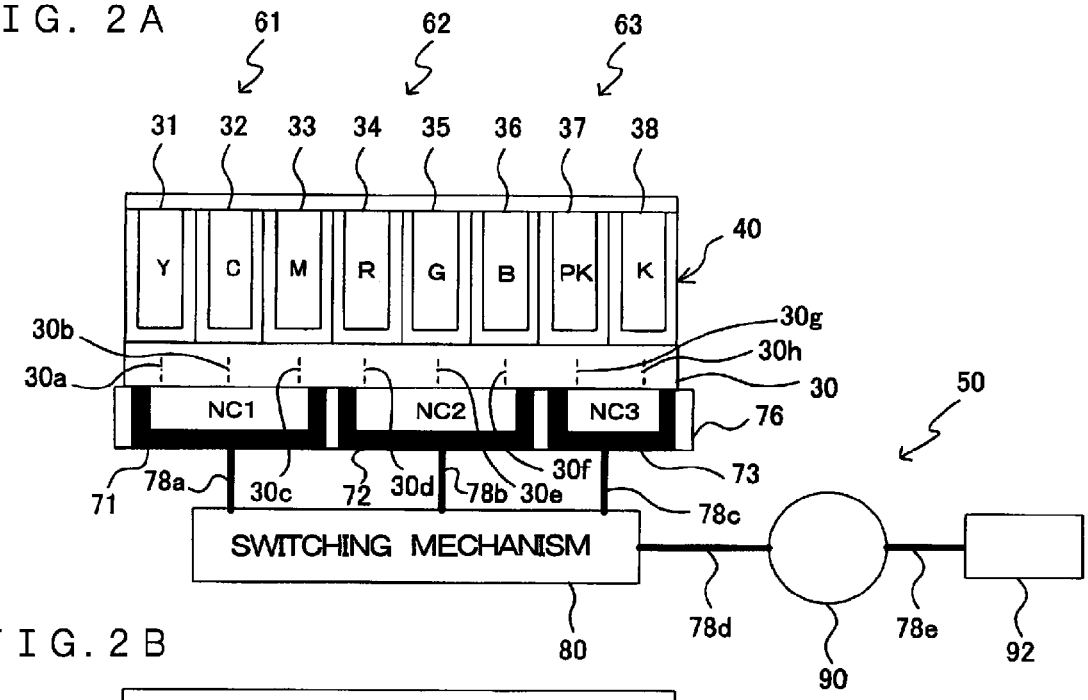
FIG. 2A is a diagram showing schematic configuration of a carriage 40 and a recovery operation unit 50 in an ink jet recording apparatus 1 of First Embodiment.

FIG. 2A is a diagram showing schematic configuration of a carriage 40 and a recovery operation unit 50 in an ink jet recording apparatus 1 of First Embodiment, and shows a state that the carriage 40 is located at a waiting position.

The recording head 30 mounted on the carriage 40 comprises eight nozzles 30*a*-30*h* for discharging ink stored in the eight ink tanks 31-38 and thereby performs image recording onto the recording medium. At that time, the eight ink tanks 31-38 mounted on the carriage 40 are composed of an ink tank group 61 consisting of the ink tanks 31-33 of Y, C, and M; an ink tank group 62 consisting of the ink tanks 34-36 of R, G, and B; and an ink tank group 63 consisting of the ink tanks 37 and 38 of photo-K and K.

Next, the recovery operation unit 50 is described below. The recovery operation unit 50 is mounted on a maintenance unit (not shown), and is arranged at a position that allows the nozzle caps 71-73 to seal the recording head 30 when the carriage 40 is located at the waiting position as shown in FIG. 2A. Further, the recovery operation unit 50 comprises: a nozzle cap moving mechanism 76 that carries the three nozzle caps 71-73; a suction pump (a pressure unit) 90 for sucking ink; a switching mechanism 80 for selecting a nozzle cap 71-73 from which ink is to be sucked; and a waste liquid foam 92 for absorbing the sucked ink.

The above-mentioned three nozzle caps 71-73 are provided at positions that allow the sealing of the surface of the eight nozzles 30*a*-30*h* of the recording head 30 in a manner corresponding to the three ink tank groups 61-63.

Figure 2B:
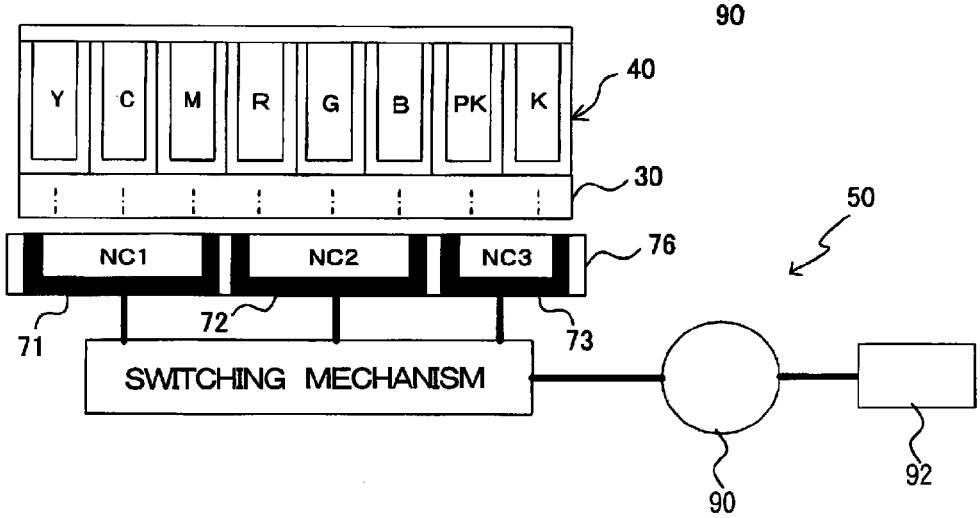
FIG. 2B is a diagram showing a state that nozzle caps 71-73 seal a recording head 30 in FIG. 2A.

Then, the nozzle cap moving mechanism 76 is provided with a drive mechanism (not shown), and can thereby move between a position where the three nozzle caps 71-73 seal the surface of the eight nozzles 30*a*-30*h* of the recording head 30 as shown in FIG. 2A and a position where the three nozzle caps 71-73 depart from the surface of the eight nozzles 30*a*-30*h* of the recording head 30 as shown in FIG. 2B.

Further, the suction pump 90 is provided for sucking ink from the three nozzle caps 71-73.

Furthermore, the switching mechanism 80 for alternatively switching the nozzle cap 71-73 from which ink is to be sucked is provided between the three nozzle caps 71-73 and the suction pump 90. Then, ink suction tubes 78*a*-78*c* for sucking the ink are provided respectively between the three nozzle caps 71-73 and the switching mechanism 80. Further, an ink suction tube 78*d* for sucking the ink is provided between the switching mechanism 80 and the suction pump 90. Furthermore, an ink suction tube 78*e* for sucking the ink is provided between the suction pump 90 and the waste liquid foam 92 for absorbing the ink sucked and discharged by the suction pump 90.

Here, in the "suction purging operation" serving as a recovery operation according to the present embodiment, approximately 0.15 cc is sucked and discharged per color per once.

Figure 3A:
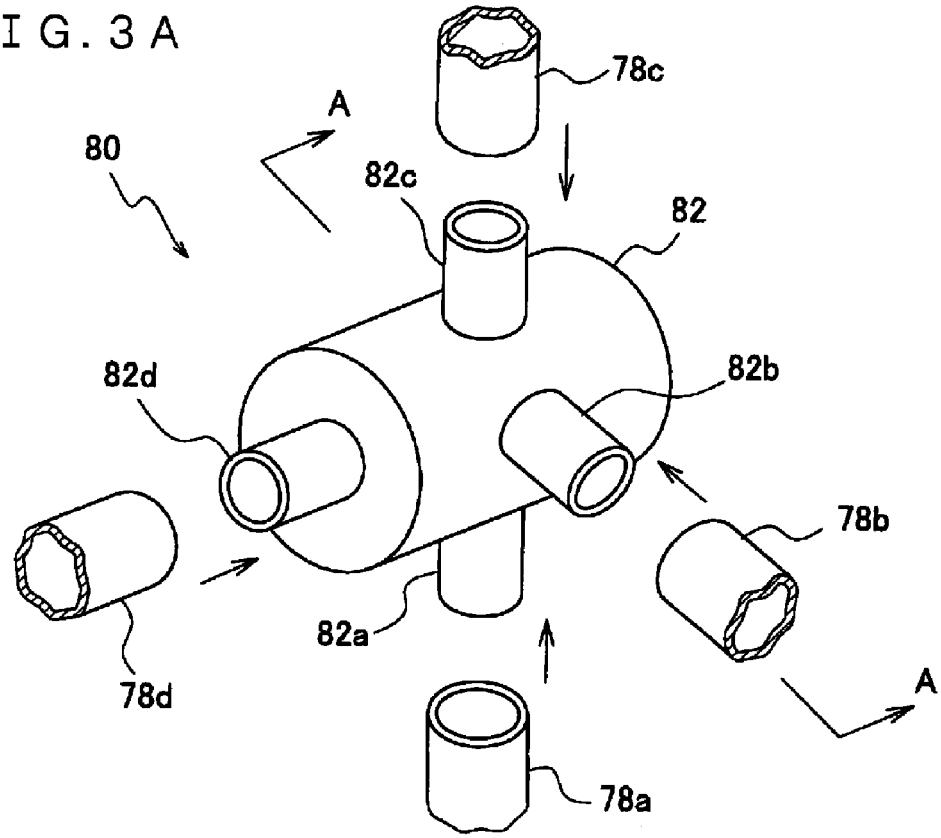
FIG. 3A is a schematic perspective view of a switching mechanism 80.

Then, FIG. 3A is a schematic perspective view of the switching mechanism 80. The switching mechanism 80 comprises: a cylindrical member 82; a rotor 84 (see FIG. 3B) mounted inside the cylindrical member 82; and a rotary drive mechanism (not shown) for rotating the rotor 84. Here, the switching mechanism 80 of First embodiment corresponds to the switching means (switching unit) described in the claims.

In the cylindrical member 82, three suction ports 82*a*-82*c* are provided at spacing of approximately 90 degrees on a circumference approximately in the center part in the longitudinal direction, while a discharge port 82*d* is provided in the center of one end of the longitudinal direction. Then, the ink suction tubes 78*a*-78*c* are fit onto the suction ports 82*a*-82*c* of the cylindrical member 82 in the arrow direction. Thus, one end of each of the ink suction tubes 78*a*-78*c* communicates with the switching mechanism 80, while the other end communicates with each of the nozzle caps 71-73 described above, so that communication is established between the nozzle caps 71-73 and the switching mechanism 80. Further, the ink suction tube 78*d* is fit onto the discharge port 82*d* of the cylindrical member 82 in the arrow direction. Thus, one end of the ink suction tube 78*d* communicates with the switching mechanism 80, while the other end communicates with the suction pump 90 described above, so that communication is established between the switching mechanism 80 and the suction pump 90 described above.

Figure 3B:
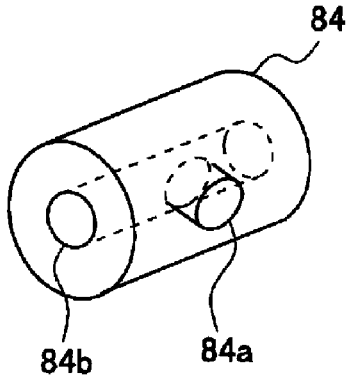
FIG. 3B is a perspective view of a rotor 84.

The rotor 84 has the shape of a pipe having a thick wall as shown in FIG. 3B. Then, in the rotor 84, a suction hole 84*a* is provided from a circumference approximately in the center part of the longitudinal direction toward the center axis, while a discharge hole 84*b* is provided in the center of one end of the longitudinal direction. Then, the suction hole 84*a* and the discharge hole 84*b* of the rotor 84 communicate with each other. Further, the rotor 84 is mounted inside the cylindrical member 82. Then, when the rotation angle of the rotor 84 is changed, the suction hole 84*a* of the rotor 84 communicates with each of the three suction ports 82*a*-82*c* of the cylindrical member 82. Further, the discharge hole 84*b* of the rotor 84 is formed at a position establishing communication with the discharge port 82*d* of the cylindrical member 82 in a state that the rotor 84 is mounted inside the cylindrical member 82.

Here, switching of the communication between the nozzle caps 71-73 and the suction pump 90 is described below.

Figure 4A:
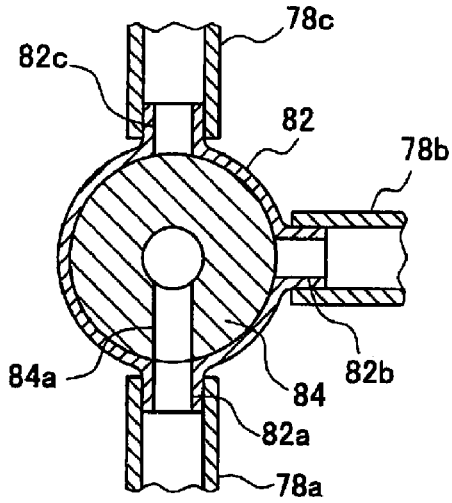
FIG. 4A is a sectional view taken along line A-A of FIG. 3A in a case that a nozzle cap 71 communicates with a suction pump 90.

First, FIG. 4A is a sectional view taken along line A-A of FIG. 3A in a case that the nozzle cap 71 communicates with the suction pump 90. In this case, the rotor 84 is rotated to a position that allows the suction port 82*a* of the cylindrical member 82 to communicate with the suction hole 84*a* of the rotor 84. Then, the suction port 82*a* of the cylindrical member 82, the suction hole 84*a* of the rotor 84, the discharge hole 84*b*, and the discharge port 82*d* of the cylindrical member 82 communicate with each other. Further, the suction port 82*a* of the cylindrical member 82 communicates with the nozzle cap 71 through the ink suction tube 78*a* fit onto the suction port 82*a* of the cylindrical member 82. Further, the discharge port 82*d* of the cylindrical member 82 communicates with the suction pump 90 through the ink suction tube 78*d* fit onto the discharge port 82*d* of the cylindrical member 82. As a result, the nozzle cap 71 communicates with the suction pump 90.

Figure 4B:
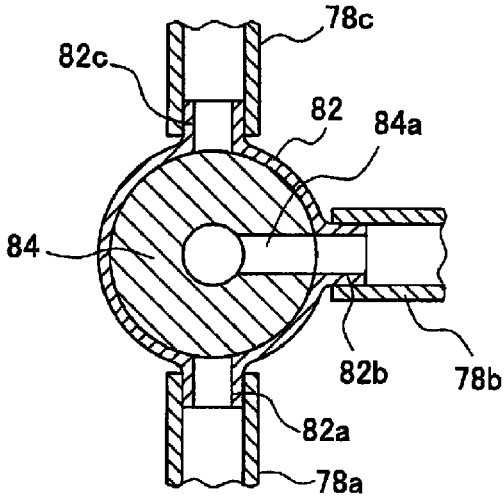
FIG. 4B is a sectional view taken along line A-A of FIG. 3A in a case that a nozzle cap 72 communicates with a suction pump 90.

Next, FIG. 4B is a sectional view taken along line A-A of FIG. 3A in a case that the nozzle cap 72 communicates with the suction pump 90. In this case, the rotor 84 is rotated to a position that allows the suction port 82*b* of the cylindrical member 82 to communicate with the suction hole 84*a* of the rotor 84. Then, the suction port 82*b* of the cylindrical member 82, the suction hole 84*a* of the rotor 84, the discharge hole 84*b*, and the discharge port 82*d* of the cylindrical member 82 communicate with each other. Further, the suction port 82*b* of the cylindrical member 82 communicates with the nozzle cap 72 through the ink suction tube 78*b* fit onto the suction port 82*b* of the cylindrical member 82. Further, the discharge port 82*d* of the cylindrical member 82 communicates with the suction pump 90 through the ink suction tube 78*d* fit onto the discharge port 82*d* of the cylindrical member 82. As a result, the nozzle cap 72 communicates with the suction pump 90.

Figure 4C:
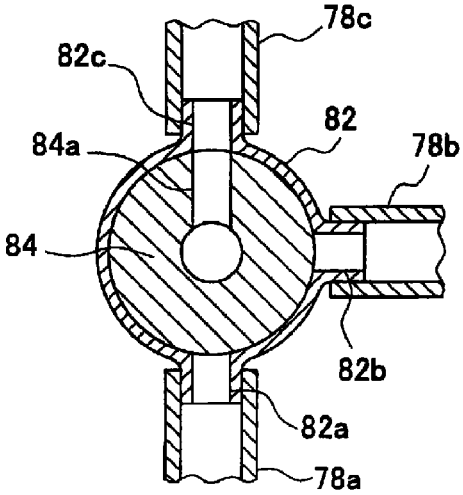
FIG. 4C is a sectional view taken along line A-A of FIG. 3A in a case that a nozzle cap 73 communicates with a suction pump 90.

Further, FIG. 4C is a sectional view taken along line A-A of FIG. 3A in a case that the nozzle cap 73 communicates with the suction pump 90. In this case, the rotor 84 is rotated to a position that allows the suction port 82*c* of the cylindrical member 82 to communicate with the suction hole 84*a* of the rotor 84. Then, the suction port 82*c* of the cylindrical member 82, the suction hole 84*a* of the rotor 84, the discharge hole 84*b*, and the discharge port 82*d* of the cylindrical member 82 communicate with each other. Further, the suction port 82*c* of the cylindrical member 82 communicates with the nozzle cap 73 through the ink suction tube 78*c* fit onto the suction port 82*c* of the cylindrical member 82. Further, the discharge port 82*d* of the cylindrical member 82 communicates with the suction pump 90 through the ink suction tube 78*d* fit onto the discharge port 82*d* of the cylindrical member 82. As a result, the nozzle cap 73 communicates with the suction pump 90.

[Description of Other Configuration]

Figure 2C:
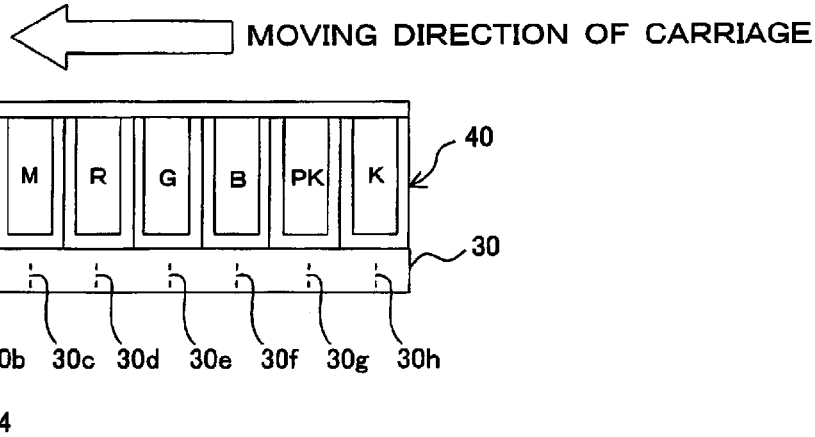
FIG. 2C is a schematic diagram showing a state that the surface of nozzles 30*a*-30*h* of a recording head 30 mounted on a carriage 40 is wiped by a blade 94.

FIG. 2C is a schematic diagram showing a state that the surface of the nozzles 30*a*-30*h* of the recording head 30 mounted on the carriage 40 is wiped by a blade 94 by means of a moving operation of the carriage 40. This blade 94 is mounted on the maintenance unit (not shown), and is composed for example of a known elastic body such as urethane rubber. Here, the operation of wiping the surface of the nozzles 30*a*-30*h* of the recording head 30 is referred to as "wiping".

Further, a flushing foam (not shown) mounted on the maintenance unit (not shown) is provided on the opposite side to the recovery operation unit 50 across the recording medium. The flushing foam (not shown) receives and thereby absorbs the ink discharged from the nozzles 30*a*-30*h* of the recording head 30. Here, the operation of discharging ink from the inside of the nozzles 30*a*-30*h* of the recording head 30 is referred to as "color mixing preventive flushing".

Figure 5:
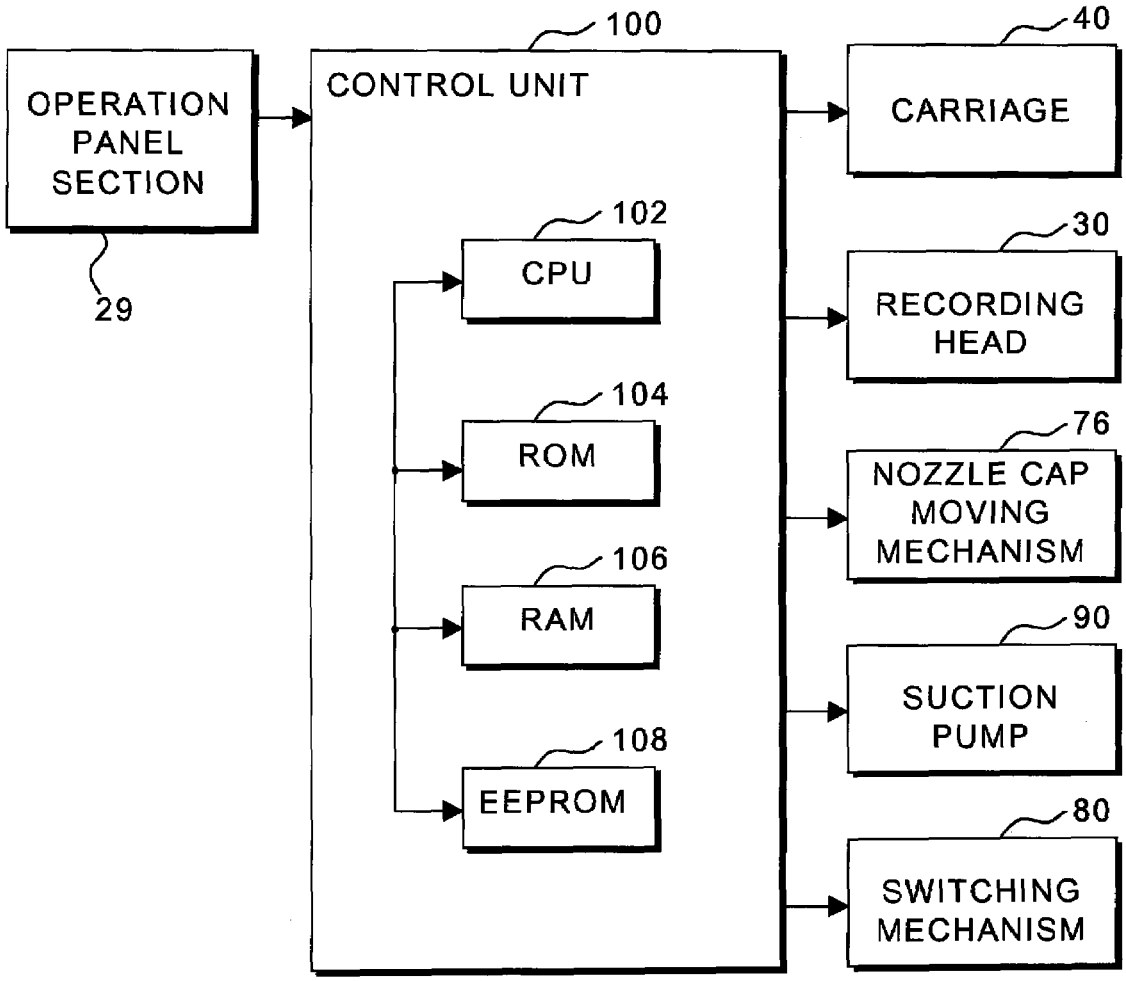
FIG. 5 is a block diagram showing schematic configuration of a control unit 100 in an ink jet recording apparatus 1.

FIG. 5 is a block diagram showing schematic configuration of a control unit 100 in the ink jet recording apparatus 1 of the present embodiment. As shown in FIG. 5, the control unit 100 comprises a CPU 102, a ROM 104, a RAM 106, and an EEPROM 108. Further, the control unit 100 is electrically connected respectively to the operation panel section 29, the carriage 40, the recording head 30, the nozzle cap moving mechanism 76, the suction pump 90, and the switching mechanism 80. In this control unit 100, in response to a recovery operation reception instruction from the operation panel section 29, the CPU 102 controls the driving of each component connected to the control unit 100.

The configuration of the ink jet recording apparatus 1 of the present embodiment has been described above. Then, recovery operation processing is described below. After a user recognizes abnormal discharge such as skipped printing, a recovery operation is started when the user specifies an ink color where abnormal discharge occurs, by using operation buttons of the operation panel section 29.

[Description of Recovery Operation Processing]

Figure 6:
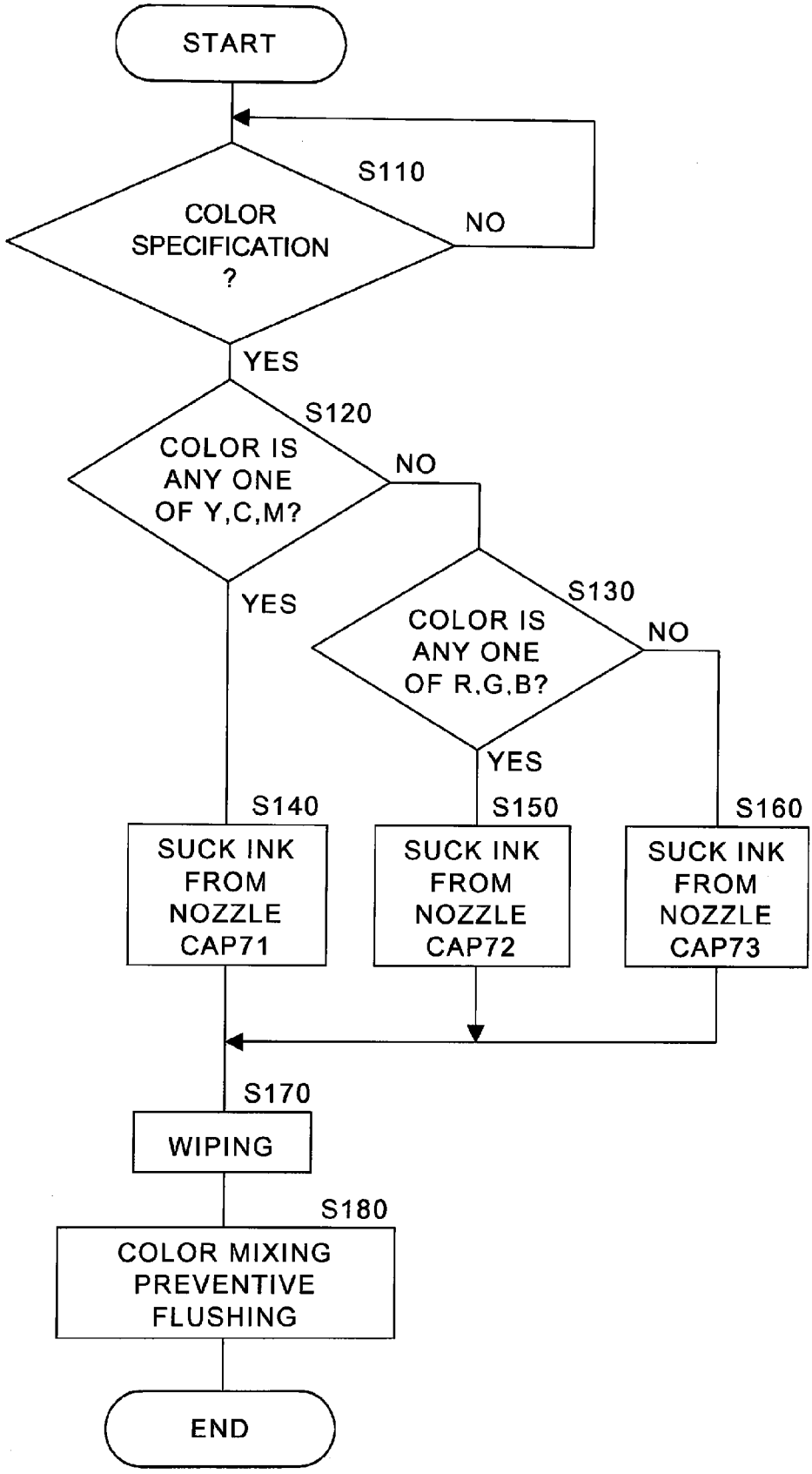
FIG. 6 is a flow chart showing a procedure of "recovery operation processing" performed by a control unit 100 of an ink jet recording apparatus 1.

The procedure of "recovery operation processing" executed by the control unit 100 of the ink jet recording apparatus 1 is described below with reference to the flow chart of FIG. 6. Here, this "recovery operation processing" is executed on the assumption that the carriage 40 carrying the recording head 30 and the eight ink tanks 31-38 is located at the waiting position as shown in FIG. 2A and that that the nozzle caps 71-73 are in a state of sealing the recording head 30.

The data of color specification received through the operation buttons of the operation panel section 29 and specifying an ink tank for which the recovery operation is to be performed is transmitted to the control unit 100. The control unit 100 determines whether the data of color specification of an ink tank has been received (S110). Then, on receiving the data of color specification of an ink tank transmitted from the operation panel section 29 (S110: Yes), the control unit 100 determines whether the color specification of an ink tank corresponds to any one of Y, C, and M (S120).

Then, when the color specification of an ink tank corresponds to any one of Y, C, and M (S120: Yes), ink is sucked from the nozzle cap 71 corresponding to the ink tank group 61 consisting of the ink tanks 31, 32, and 33 of Y, C, and M (S140). That is, the switching mechanism 80 is controlled so that the specified nozzle cap 71 communicates with the suction pump 90. Then, the suction pump 90 is controlled so that ink is sucked from the nozzle cap 71 via the ink suction tube 78*a*, the switching mechanism 80, and the ink suction tube 78*d*. Then, the ink sucked by the suction pump 90 is discharged to the waste liquid foam 92, and thereby absorbed by the waste liquid foam 92.

In contrast, when the color specification of an ink tank does not correspond to any one of Y, C, and M (S120: No), the control unit 100 determines whether the color specification of an ink tank corresponds to any one of R G, and B (S130). Then, when the color specification of an ink tank corresponds to any one of R, G, and B (S130: Yes), ink is sucked from the nozzle cap 72 corresponding to the ink tank group 62 consisting of the ink tanks 34, 35, and 36 of R, G, and B (S150). That is, the switching mechanism 80 is controlled so that the specified nozzle cap 72 communicates with the suction pump 90. Then, the suction pump 90 is controlled so that ink is sucked from the nozzle cap 72 via the ink suction tube 78*b*, the switching mechanism 80, and the ink suction tube 78*d*. Here, the disposal of the ink sucked by the suction pump 90 is similar to the above-mentioned case of being in correspondence to any one of Y, C, and M.

Further, when the color specification of an ink tank does not correspond to any one of R, G, and B (S130: No), ink is sucked from the nozzle cap 73 corresponding to the ink tank group 63 consisting of the ink tanks 37 and 38 of photo-K and K (S160). That is, the switching mechanism 80 is controlled so that the specified nozzle cap 73 communicates with the suction pump 90. Then, the suction pump 90 is controlled so that ink is sucked from the nozzle cap 73 via the ink suction tube 78*c*, the switching mechanism 80, and the ink suction tube 78*d*. Here, the disposal of the ink sucked by the suction pump 90 is similar to the above-mentioned case of being in correspondence to any one of Y, C, and M.

After the ink is sucked from the nozzle caps 71-73 in accordance to the color specification of an ink tank, as described above (S140, S150, and S160), control is performed such that wiping should be performed, that is, the surface of the nozzles 30*a*-30*h* of the recording head 30 should be wiped (S170). Specifically, as shown in FIG. 2B, the nozzle cap moving mechanism 76 is controlled such that the nozzle caps 71-73 should depart from the recording head 30. Then, as shown in FIG. 2C, the carriage 40 is controlled such that the carriage 40 should move in such a manner that the blade 94 would wipe the surface of the nozzles 30*a*-30*h* of the recording head 30.

Then, the recording head 30 is controlled such that color mixing preventive flushing should be performed, that is, ink should be discharged from the inside of the nozzles 30*a*-30*h* of the recording head 30 to the flushing foam (not shown) (S180). Specifically, the carriage 40 is controlled such that the carriage 40 should move in such a manner that the recording head 30 mounted on the carriage 40 would reach the position of flushing foam (not shown). Then, the recording head 30 is controlled such that ink should be discharged from the inside of the nozzles 30*a*-30*h* of the recording head 30.

When the color mixing preventive flushing at S180 is finished, the present "recovery operation processing" is completed.

First embodiment has been described above. However, it is not limited to the above-mentioned embodiment, and may be implemented in the following various modes.

Second Embodiment

In First embodiment, the ink tanks have been composed of an ink tank group 61 consisting of the ink tanks 31-33 of Y, C, and M; an ink tank group 62 consisting of the ink tanks 34-36 of R, G, and B; and an ink tank group 63 consisting of the ink tanks 37 and 38 of photo-K and K. However, it is not limited to this. As long as obtained quality falls within allowance of the quality standard of black recording, the above-mentioned ink tanks 37 and 38 of photo-K and K may be replaced by an ink tank group consisting solely of the ink tank 38 of K.

Figure 7A:
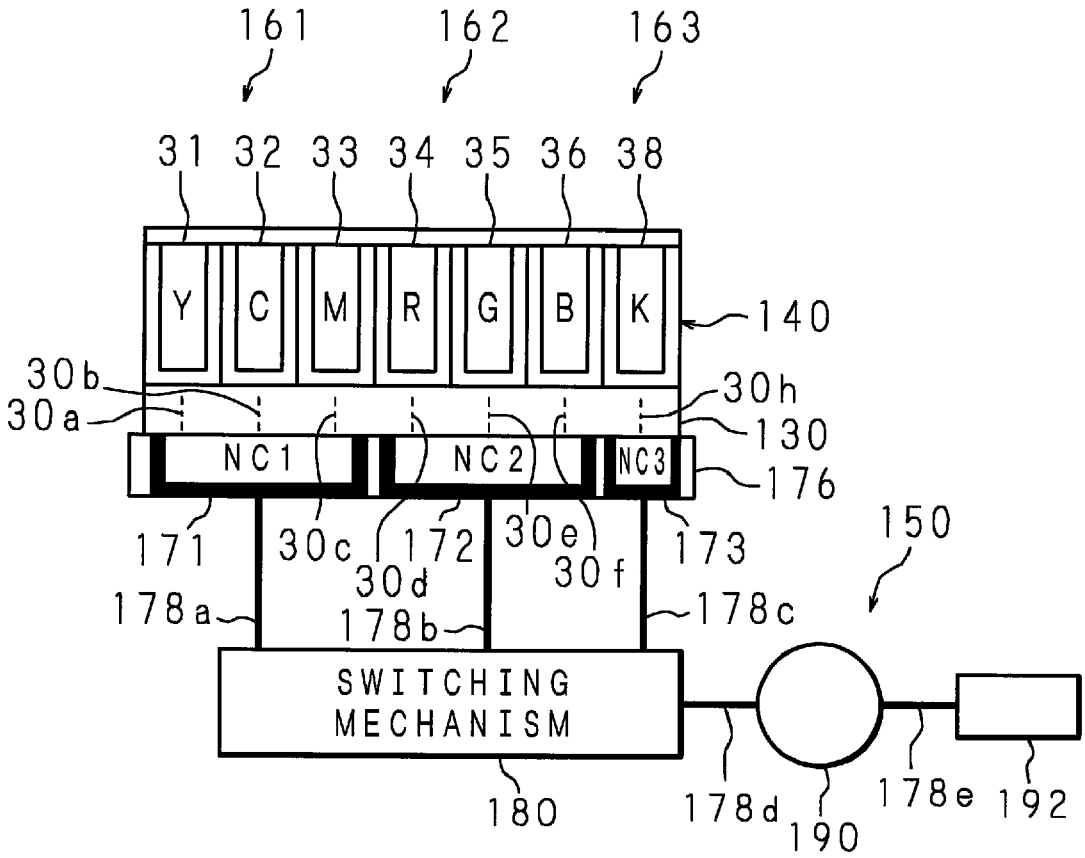
FIG. 7A is a diagram showing schematic configuration of a carriage 140 and a recovery operation unit 150 in an ink jet recording apparatus 1 of Second Embodiment.

FIG. 7A is a diagram showing schematic configuration of a carriage 140 and a recovery operation unit 150 in an ink jet recording apparatus 1 of Second Embodiment, and shows a state that the carriage 140 is located at a waiting position.

The recording head 130 mounted on the carriage 140 comprises seven nozzles 30*a*-30*f*, 30*h* for discharging ink stored in the seven ink tanks 31-36, 38 and thereby performs image recording onto the recording medium. At that time, the seven ink tanks 31-36, 38 mounted on the carriage 140 are composed of an ink tank group 161 consisting of the ink tanks 31-33 of Y, C, and M; an ink tank group 162 consisting of the ink tanks 34-36 of R, G, and B; and an ink tank group 163 consisting of the ink tank 38 of K.

Next, the recovery operation unit 150 is described below. The recovery operation unit 150 is mounted on a maintenance unit (not shown), and is arranged at a position that allows the nozzle caps 171-173 to seal the recording head 130 when the carriage 140 is located at the waiting position as shown in FIG. 7A. Further, the recovery operation unit 150 comprises: a nozzle cap moving mechanism 176 that carries the three nozzle caps 171-173; a suction pump (a pressure unit) 190 for sucking ink; a switching mechanism 180 for selecting a nozzle cap 171-173 from which ink is to be sucked; and a waste liquid foam 192 for absorbing the sucked ink.

Here, the switching mechanism 180 of Second embodiment corresponds to the switching means (switching unit) described in the claims.

The above-mentioned three nozzle caps 171-173 are provided at positions that allow the sealing of the surface of the seven nozzles 30*a*-30*f*, 30*h* of the recording head 130 in a manner corresponding to the three ink tank groups 161-163.

Figure 7B:
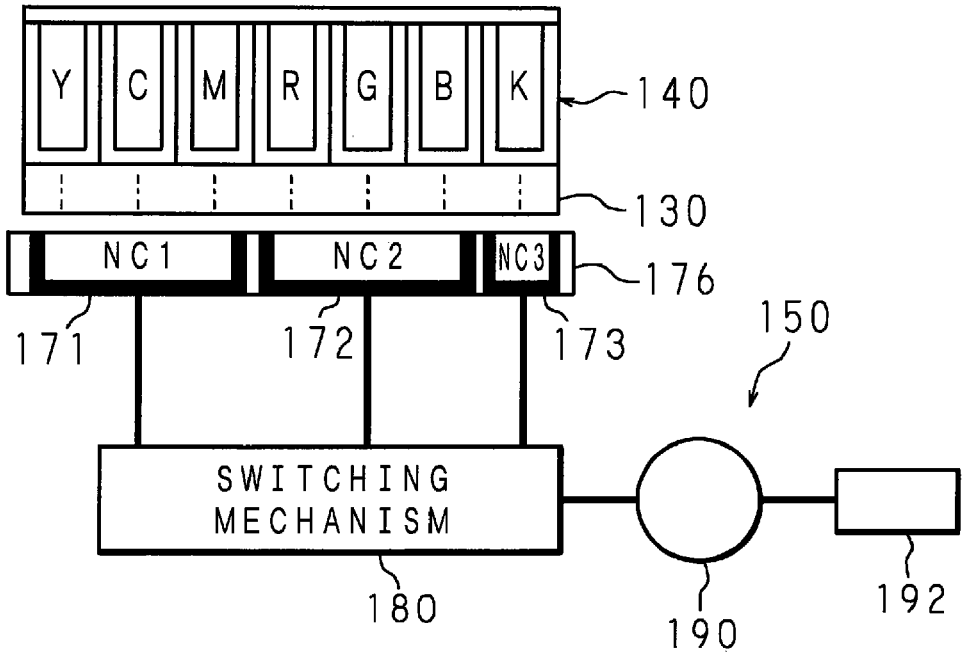
FIG. 7B is a diagram showing a state that nozzle caps 171-173 seal a recording head 130 in FIG. 7A.

Then, the nozzle cap moving mechanism 176 is provided with a drive mechanism (not shown), and can thereby move between a position where the three nozzle caps 171-173 seal the surface of the seven nozzles 30*a*-30*f*, 30*h* of the recording head 130 as shown in FIG. 7A and a position where the three nozzle caps 171-173 depart from the surface of the seven nozzles 30*a*-30*f*, 30*h* of the recording head 130 as shown in FIG. 7B.

Further, the suction pump 190 is provided for sucking ink from the three nozzle caps 171-173.

Furthermore, the switching mechanism 180 for alternatively switching the nozzle cap 171-173 from which ink is to be sucked is provided between the three nozzle caps 171-173 and the suction pump 190. Then, ink suction tubes 178*a*-178*c* for sucking the ink are provided respectively between the three nozzle caps 171-173 and the switching mechanism 180. Further, an ink suction tube 178*d* for sucking the ink is provided between the switching mechanism 180 and the suction pump 190. Furthermore, an ink suction tube 178*e* for sucking the ink is provided between the suction pump 190 and the waste liquid foam 192 for absorbing the ink sucked and discharged by the suction pump 190.

The other arrangements and actions are identical to those of First Embodiment and will be described in no more detail.

Third Embodiment

Further, as long as color mixing with black ink that could occur in the nozzles 30*a*-30*f* for color falls within allowance of the quality standard of color recording, the ink tanks 31-38 may be composed of an ink tank group consisting of the ink tanks 31-33 and 38 of Y, C, M, and K; and an ink tank group consisting of the ink tanks 34-37 of R, G, B, and photo-K.

Figure 8A:
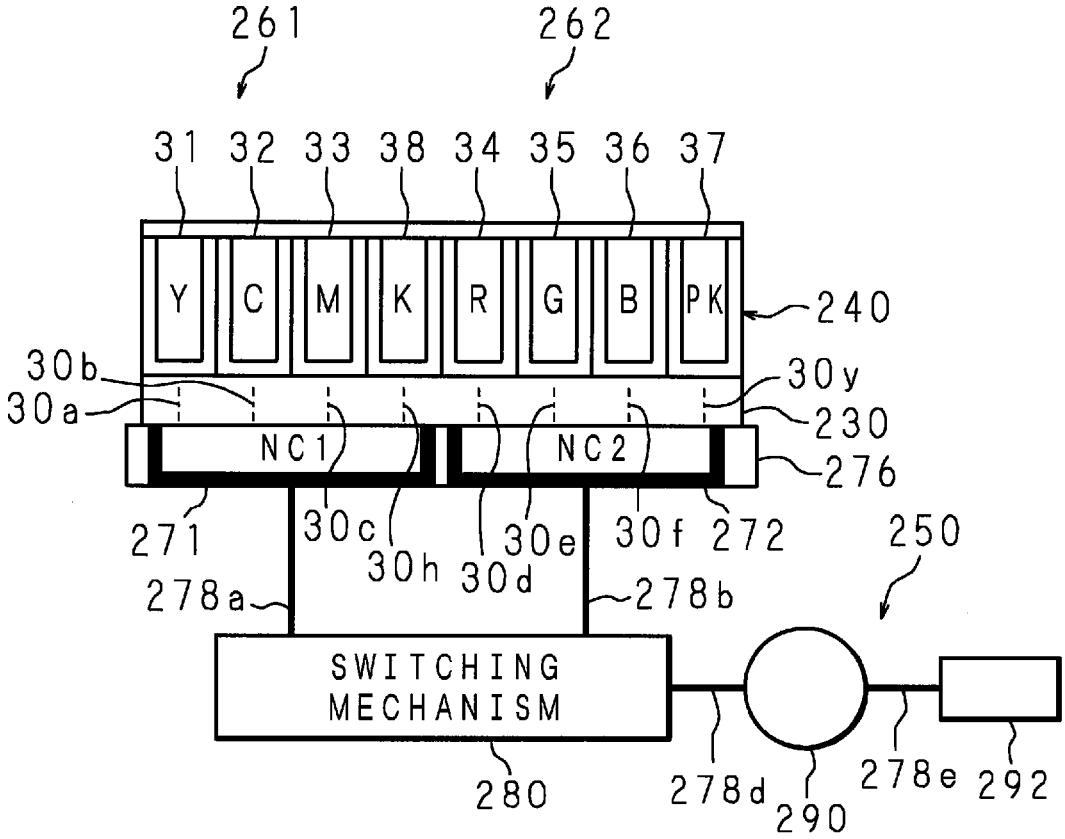
FIG. 8A is a diagram showing schematic configuration of a carriage 240 and a recovery operation unit 250 in an ink jet recording apparatus 1 of Third Embodiment.

FIG. 8A is a diagram showing schematic configuration of a carriage 240 and a recovery operation unit 250 in an ink jet recording apparatus 1 of Third Embodiment, and shows a state that the carriage 240 is located at a waiting position.

The recording head 230 mounted on the carriage 240 comprises eight nozzles 30*a*-30*h* for discharging ink stored in the eight ink tanks 31-38 and thereby performs image recording onto the recording medium. At that time, the eight ink tanks 31-38 mounted on the carriage 240 are composed of an ink tank group 261 consisting of the ink tanks 31-33, 38 of Y, C, M, and K; and an ink tank group 262 consisting of the ink tanks 34-37 of R, G, B, and photo-K.

Next, the recovery operation unit 250 is described below. The recovery operation unit 250 is mounted on a maintenance unit (not shown), and is arranged at a position that allows the nozzle caps 271, 272 to seal the recording head 230 when the carriage 240 is located at the waiting position as shown in FIG. 8A. Further, the recovery operation unit 250 comprises: a nozzle cap moving mechanism 276 that carries the two nozzle caps 271, 272; a suction pump (a pressure unit) 290 for sucking ink; a switching mechanism 280 for selecting a nozzle cap 271, 272 from which ink is to be sucked; and a waste liquid foam 292 for absorbing the sucked ink.

Here, the switching mechanism 280 of Third embodiment corresponds to the switching means (switching unit) described in the claims.

The above-mentioned two nozzle caps 271, 272 are provided at positions that allow the sealing of the surface of the eight nozzles 30*a*-30*h* of the recording head 230 in a manner corresponding to the two ink tank groups 261, 262.

Figure 8B:
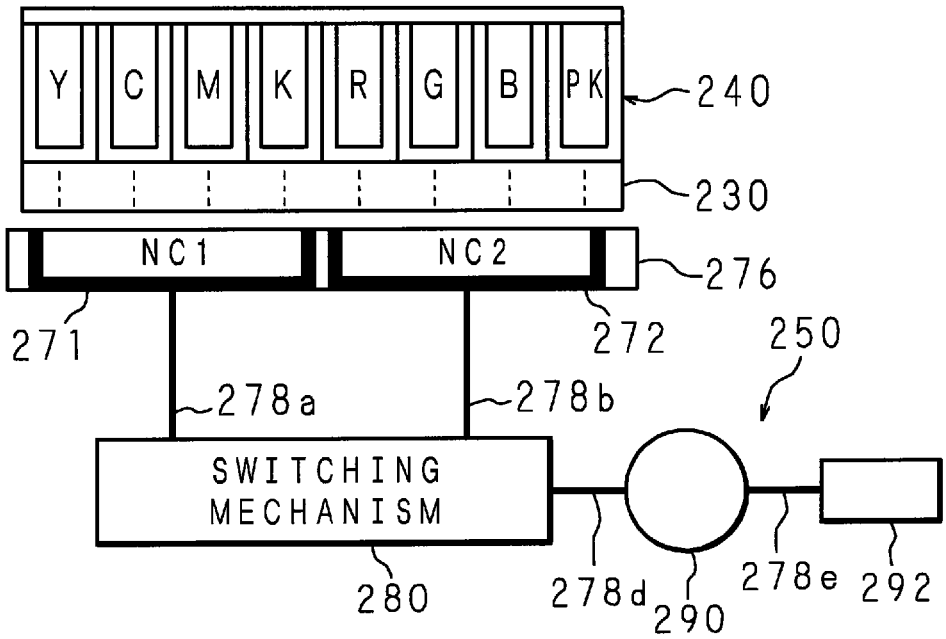
FIG. 8B is a diagram showing a state that nozzle caps 271, 272 seal a recording head 230 in FIG. 8A.

Then, the nozzle cap moving mechanism 276 is provided with a drive mechanism (not shown), and can thereby move between a position where the two nozzle caps 271, 272 seal the surface of the eight nozzles 30*a*-30*h* of the recording head 230 as shown in FIG. 8A and a position where the two nozzle caps 271, 272 depart from the surface of the eight nozzles 30*a*-30*h* of the recording head 230 as shown in FIG. 8B.

Further, the suction pump 290 is provided for sucking ink from the two nozzle caps 271, 272.

Furthermore, the switching mechanism 280 for alternatively switching the nozzle cap 271, 272 from which ink is to be sucked is provided between the two nozzle caps 271, 272 and the suction pump 290. Then, ink suction tubes 278*a*, 278*b* for sucking the ink are provided respectively between the two nozzle caps 271, 272 and the switching mechanism 280. Further, an ink suction tube 278*d* for sucking the ink is provided between the switching mechanism 280 and the suction pump 290. Furthermore, an ink suction tube 278*e* for sucking the ink is provided between the suction pump 290 and the waste liquid foam 292 for absorbing the ink sucked and discharged by the suction pump 290.

The other arrangements and actions are identical to those of First Embodiment and will be described in no more detail.

Other Embodiments (a) In the configuration of the above-mentioned embodiments, one suction pump 90 and one switching mechanism 80 have been provided. However, it is not limited to this. A suction pump may be provided for each nozzle cap. This avoids the necessity of the switching mechanism, and hence serves as an effective configuration when merely a small number of ink tank groups are used so that merely a small number of nozzle caps are provided in correspondence to them.

(b) In the above-mentioned embodiments, the recovery operation has been assumed to be started when a user has recognized abnormal discharge such as skipped printing and then the user has specified the ink color of abnormal discharge by using operation buttons of the operation panel section 29. However, it is not limited to this. First, the control unit 100 stores the data of color specification of an ink tank requiring a recovery operation which has been received through the operation buttons of the operation panel section 29 as well as the data of time, into the EEPROM 108 of the control unit 100. Then, the control unit 100 performs statistical calculation for the period of receiving recovery operation instructions for each of the ink tank groups corresponding to the color of the ink tank, by using the CPU 102 of the control unit 100. The control unit 100 thereby generates a schedule of recovery operations to be performed for each ink tank group, and then stores the schedule into the EEPROM 108. After that, the control unit 100 reads the schedule of recovery operations to be performed for each ink tank group stored in the EEPROM 108. Then, at each time point that a recovery operation should be performed, the control unit 100 automatically controls the recovery operation. Such automation allows the quality of color recording to be maintained without the necessity of the user's time and effort.

(c) In the configuration of the above-mentioned embodiments, the suction pump is provided and sucks ink via the nozzle cap. However, it is not limited to this. A pressure pump is provided on the ink tank side and the pressure purging mechanism may be employed that ink is discharged from the recording head into the nozzle cap by the pressure pump. Furthermore, without providing a pump, a flushing operation may be performed by driving an actuator (for example, a piezoelectric element, an electrostriction element) of the recording head to discharge ink from the nozzles of the recording head.

Description of Effect: 1

(1) In the prior art, in a case that an ink tank group has a high frequency of recovery operations while another ink tank group has a low frequency of recovery operations, suction purging operations for the ink tank group having a low frequency of recovery operations have been performed at the same time as those for the ink tank group having a high frequency of recovery operations. This has caused uselessly discarded ink in the ink tank group having a low frequency of recovery operations.

In contrast, according to the present embodiment, in accordance with: an ink tank group 61 consisting of the ink tanks 31-33 of Y, C, and M; an ink tank group 62 consisting of the ink tanks 34-36 of R, G, and B; and an ink tank group 63 consisting of the ink tanks 37 and 38 of photo-K and K, the three nozzle caps 71-73 are provided for sealing the surface of the eight nozzles 30*a*-30*h* of the recording head 30. Thus, ink can be sucked separately for each of the three nozzle caps 71-73 by the suction pump 90. That is, a recovery operation can be performed separately for each of the three ink tank groups 61-63. This avoids that a suction purging operation for the ink tank group having a low frequency of recovery operations is performed at the same time as that for the ink tank group having a high frequency of recovery operations. This reduces uselessly discarded ink in the ink tank group having a low frequency of recovery operations.

(2) Further, the ink tanks 37 and 38 for black inks of photo-K and K are provided separately from an ink tank group 61 consisting of the ink tanks 31-33 for the colors of Y, C, and M; and an ink tank group 62 consisting of the ink tanks 34-36 of R, G, and B. Then, the nozzle cap 73 provided in correspondence to the ink tank group 63 consisting of the ink tanks 37 and 38 for black inks of photo-K and K is separated from the nozzle caps 71 and 72 provided in correspondence to the ink tank group 61 and the ink tank group 62 for color. This avoids that the black inks mix into the color inks within the nozzle cap 71 and 72 at the time of ink suction for color, and hence reduces color mixing within the nozzles 30*a*-30*f* for color.

(3) Further, the switching mechanism 80 for alternatively switching the nozzle cap 71-73 from which ink is to be sucked is provided between the three nozzle caps 71-73 and the suction pump 90. Thus, ink can be sucked from an alternatively switched nozzle cap through the switching mechanism 80 by using the single suction pump 90.

(4) Further, when the blade 94 wipes the surface of the nozzles 30*a*-30*h* of the recording head 30 by means of the movement of the carriage, the wiping is performed starting at the light-color group. That is, the ink tanks 31-38 are arranged such that the blade 94 should wipe in the order of an ink tank group 61 consisting of the ink tanks 31-33 for the colors of Y, C, and M; an ink tank group 62 consisting of the ink tanks 34-36 of R, G, and B; and an ink tank group 63 consisting of the ink tanks 37 and 38 for the blacks of photo-K and K. This reduces color mixing within the nozzles 30*a*-30*f* for color that could arise in association with wiping.

Description of Effect: 2

(1) In an ink jet recording apparatus capable of color recording using ink of a plural of colors (e.g., Y, C, M, R, G, B, and K), different types of ink are used in a general image quality mode and a high-quality mode. That is, Y, C, M, and K are used in the general image quality mode, while R, G, and B are also used in the high-quality mode in addition to Y, C, M, and K. Thus, the group of the ink tanks of Y, C, M, and K and the group of the ink tanks of R, G, and B have different frequencies of ink use from each other. This difference in the frequency of ink use causes a difference in the frequency of recovery operations. This is because in the recording in the general image quality mode, ink tanks that require the user's check of poor ink discharge and the recovery operation are solely those of the group of the ink tanks of Y, C, M, and K. That is, no recovery operation is necessary for the group of the ink tanks of R, G, and B.

Here, in the case that the ink tanks of Y, C, M, and K are classified into one group, when a suction purging operation of recovery operation is performed in the same nozzle cap, these inks are mixed with each other in the nozzle cap. Then, when the suction purging operation of recovery operation is completed, the color-mixed ink generated by the discharge pressure of the nozzles is slightly sucked into and adheres to the nozzle of each ink. In particular, the ink of K causes easily recognizable color mixing in comparison with the inks of Y, C, and M. Thus, it is preferable that the ink of K is separated into another group. That is, preferably, K is separated into a group independent of the group of the inks of Y, C, and M.

In conclusion, with taking into consideration the recovery frequency and the color mixing prevention, the ink tanks may preferably be classified into: an ink tank group consisting of the ink tanks of Y, C, and M; an ink tank group consisting of the ink tanks of R, G, and B; and an ink tank group consisting of the ink tank of K.

(2) In general, as for the material of the ink of K, an ink of pigment family is used. However, the ink of photo-K is of dye family similar to those of Y, C, and M. Thus, in delicate color recording that requires high image quality like that of photographs, the ink of photo-K is used more frequently than the ink of K. Accordingly, also in the case of an apparatus capable of delicate color recording that requires high image quality like that of photographs, photo-K and K may preferably be separated into an ink group independent of the group of the inks of Y, C, and M for the purpose of preventing color mixing.

(3) According to an ink jet recording apparatus provided with the switching means, without the necessity of providing a suction pump for each ink tank group, the switching means alternatively switches a plurality of ink tank groups, and thereby allows a single suction pump to perform a suction purging operation of recovery operation. Thus, when a nozzle cap is provided for each of a plurality of ink tank groups so that a suction purging operation of recovery operation is performed for each ink tank group, the increase of apparatus size can be avoided.

As this description may be embodied in several forms without departing from the spirit of essential characteristics thereof, this embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An ink jet recording apparatus comprising:

a plurality of ink tanks each for storing ink of each color;

a recording head provided with nozzles for discharging onto a recording medium the ink stored in said plurality of ink tanks;

a nozzle cap for sealing the surface of said recording head in which said nozzles are formed; and a pressure unit for applying pressure to discharge the ink from said recording head into said nozzle cap, wherein said plurality of ink tanks are classified into:

an ink tank group consisting of ink tanks of three colors of yellow, cyan, and magenta;

an ink tank group consisting of ink tanks of three colors of red, green, and blue; and an ink tank group consisting of an ink tank of black, and wherein a plurality of said nozzle caps are provided in correspondence to the groups of said classified ink tanks.

2. The ink jet recording apparatus according to claim 1, farther comprising a switching unit provided between said plurality of nozzle caps and said pressure unit and capable of alternatively switching communication of said plurality of nozzle caps with said pressure unit.

3. The ink jet recording apparatus according to claim 2, wherein said switching unit comprises:

a cylindrical member provided with suction ports corresponding to said plurality of nozzle caps; and a rotor mounted inside the cylindrical member and provided with a suction hole, and wherein when said rotor rotates so that any one of said suction ports communicates with said suction hole, any one of said nozzle caps communicates with said pressure unit.

4. The ink jet recording apparatus according to claim 1, further comprising switching means provided between said plurality of nozzle caps and said pressure unit and capable of alternatively switching communication of said plurality of nozzle caps with said pressure unit.

5. The ink jet recording apparatus according to claim 4, wherein said switching means comprises:

a cylindrical member provided with suction ports corresponding to said plurality of nozzle caps; and a rotor mounted inside the cylindrical member and provided with a suction hole, and wherein when said rotor rotates so that any one of said suction ports communicates with said suction hole, any one of said nozzle caps communicates with said pressure unit.

6. An ink jet recording apparatus comprising:

a plurality of ink tanks each for storing ink of each color;

a recording head provided with nozzles for discharging onto a recording medium the ink stored in said plurality of ink tanks;

a nozzle cap for sealing the surface of said recording head in which said nozzles are formed; and a pressure unit for applying pressure to discharge the ink from said recording head into said nozzle cap, wherein said plurality of ink tanks are classified into:

an ink tank group consisting of ink tanks of three colors of yellow, cyan, and magenta;

an ink tank group consisting of ink tanks of three colors of red, green, and blue; and an ink tank group consisting of ink tanks of two colors of photo black and black, and wherein a plurality of said nozzle caps are provided in correspondence to the groups of said classified ink tanks.

7. The ink jet recording apparatus according to claim 6, further comprising a switching unit provided between said plurality of nozzle caps and said pressure unit and capable of alternatively switching communication of said plurality of nozzle caps with said pressure unit.

8. The ink jet recording apparatus according to claim 7, wherein said switching unit comprises:

a cylindrical member provided with suction ports corresponding to said plurality of nozzle caps; and a rotor mounted inside the cylindrical member and provided with a suction hole, and wherein when said rotor rotates so that any one of said suction ports communicates with said suction hole, any one of said nozzle caps communicates with said pressure unit.

9. The ink jet recording apparatus according to claim 6, further comprising switching means provided between said plurality of nozzle caps and said pressure unit and capable of alternatively switching communication of said plurality of nozzle caps with said pressure unit.

10. The ink jet recording apparatus according to claim 9, wherein said switching means comprises:

a cylindrical member provided with suction ports corresponding to said plurality of nozzle caps; and a rotor mounted inside the cylindrical member and provided with a suction hole, and wherein when said rotor rotates so that any one of said suction ports communicates with said suction hole, any one of said nozzle caps communicates with said pressure unit.

11. An ink jet recording apparatus comprising:

a plurality of ink tanks each for storing ink of each color;

a recording head provided with nozzles for discharging onto a recording medium the ink stored in said plurality of ink tanks;

a nozzle cap for sealing the surface of said recording head in which said nozzles are formed; and a pressure unit for applying pressure to discharge the ink from said recording head into said nozzle cap, wherein said plurality of ink tanks are classified into:

an ink tank group consisting of ink tanks of four colors of yellow, cyan, magenta, and black; and an ink tank group consisting of ink tanks of four colors of red, green, blue, and photo black, and wherein a plurality of said nozzle caps are provided in correspondence to the groups of said classified ink tanks.

12. The ink jet recording apparatus according to claim 11, further comprising a switching unit provided between said plurality of nozzle caps and said pressure unit and capable of alternatively switching communication of said plurality of nozzle caps with said pressure unit.

13. The ink jet recording apparatus according to claim 12, wherein said switching unit comprises:

a cylindrical member provided with suction ports corresponding to said plurality of nozzle caps; and a rotor mounted inside the cylindrical member and provided with a suction hole, and wherein when said rotor rotates so that any one of said suction ports communicates with said suction hole, any one of said nozzle caps communicates with said pressure unit.

14. The ink jet recording apparatus according to claim 11, further comprising switching means provided between said plurality of nozzle caps and said pressure unit and capable of alternatively switching communication of say plurality of nozzle caps with said pressure unit.

15. The ink jet recording apparatus according to claim 14, wherein said switching means comprises:

a cylindrical member provided with suction ports corresponding to said plurality of nozzle caps; and a rotor mounted inside the cylindrical member and provided with a suction hole, and wherein when said rotor rotates so that any one of said suction ports communicates with said suction hole, any one of said nozzle caps communicates with said pressure unit.

* * * * *